US005649374A

United States Patent [19]

Chou

[11] Patent Number: 5,649,374

[45] Date of Patent: Jul. 22, 1997

[54] COMBINED RESILIENT SOLE OF A SHOE

[76] Inventor: Hsueh-li Chou, No. 12-1, Alley 82, Lane 14, Sec. 7 Chungshan N. Rd., Taipei, Taiwan

[21] Appl. No.: 644,906

[22] Filed: May 10, 1996

[51] Int. Cl.[6] ..... A43B 21/32; A43B 21/30

[52] U.S. Cl. ..... 36/27; 36/37; 36/38

[58] Field of Search ..... 36/27, 28, 37, 36/38

[56] References Cited

U.S. PATENT DOCUMENTS

| | | | |
|---|---|---|---|
| 1,098,241 | 5/1914 | Forray | 36/38 |
| 2,535,102 | 12/1950 | Taylor | 36/38 |
| 2,669,038 | 2/1954 | DeWerth | 36/38 |
| 4,715,130 | 12/1987 | Scatena | 36/27 |
| 5,513,448 | 5/1996 | Lyons | 36/27 X |

*Primary Examiner*—Ted Kavanaugh

*Attorney, Agent, or Firm*—William E. Pelton

[57] ABSTRACT

A combined resilient sole of a shoe comprises a sole body defining a cavity at a heel position thereof. A retaining bracket is mounted within the cavity and a number of blind holes in a surface defining the recess. A number of springs are disposed in the blind holes. A footstock is disposed over the retaining bracket. The footstock has a number of bosses extending from an undersurface thereof so that the springs may be compressed between the retaining bracket and the footstock. In a preferred embodiment, a setting sheet is disposed in the recess, and has a same dimension as that of the surface defining the recess. The setting sheet is disposed in the recess and defines a plurality of holes therein aligning with the blind holes of the recess, through which the springs may extend. In such an embodiment, a layer of sponge is covered on a top periphery of the retaining bracket to provide a resilient effect, the layer of sponge being configured as a frame.

7 Claims, 2 Drawing Sheets

COMBINED RESILIENT SOLE OF A SHOE

BACKGROUND OF THE INVENTION

1. Field of the invention

The present invention relates to a sole of a shoe, and more particularly to a combined sole of a shoe which may provide an excellent resilence when a user is walking etc.

2. Description of Related Art

Commonly used shoes are divided into various types. Since shoes are subject to a larger impact force during walking for example, it is necessary to develop a kind of resiliently-soled shoes to meet the needs of providing a cushioning effect to a user's heels. A kind of shoe with an air-cushion sole has been proposed. Though this kind of shoe may be effective by resilience employing air as the cushion medium, the resulted resilience is not sufficient from this medium, particularly when the user is performing sports where impact to a foot and shoe are increased.

The present invention therefore is aimed to provide a combined resilient sole of a shoe to mitigate and/or obviate the aforementioned problems.

SUMMARY OF THE INVENTION

One object of the present invention is to provide a combined resilient sole of a shoe which may provide an excellent resilience when a user is walking or running.

In accordance with one aspect of the present invention, the combined resilient sole of a shoe comprises a sole body with a cavity defined in a heel portion thereof; a retaining bracket mounted within the cavity, the retaining bracket defining a recess at a center thereof and a plurality of blind holes in a surface defining the recess. A plurality of springs are respectively and vertically disposed in the blind holes of the recess. A footstock, with a same dimension as that of the surface defining the recess is disposed over the retaining sheet. The footstock has a plurality of bosses extending from an undersurface thereof and each boss is respectively retained within an upper end of the springs so that the springs may be compressed between the retaining bracket and the footstock.

In accordance with another aspect of the present invention, the combined resilient sole of a shoe further comprises a setting sheet disposed in the recess. The setting sheet has a same dimension as that of the surface defining the recess and is made of a PVC material, disposed on the recess and defines a plurality of holes thereon aligning with the blind holes in the recess, through which the springs may extend and be located in.

In accordance with a further aspect of the present invention, the combined resilient sole of a shoe further comprises a layer of sponge covered on a top periphery of the retaining bracket to provide further resilient effect, the layer of sponge being configured as a frame.

Other objects, advantages, and novel features of the invention will become more apparent from the following detailed description when taken in conjunction with the accompanying drawings.

DETAILED DESCRIPTION OF PREFERRED EMBODIMENT

Figure 1:
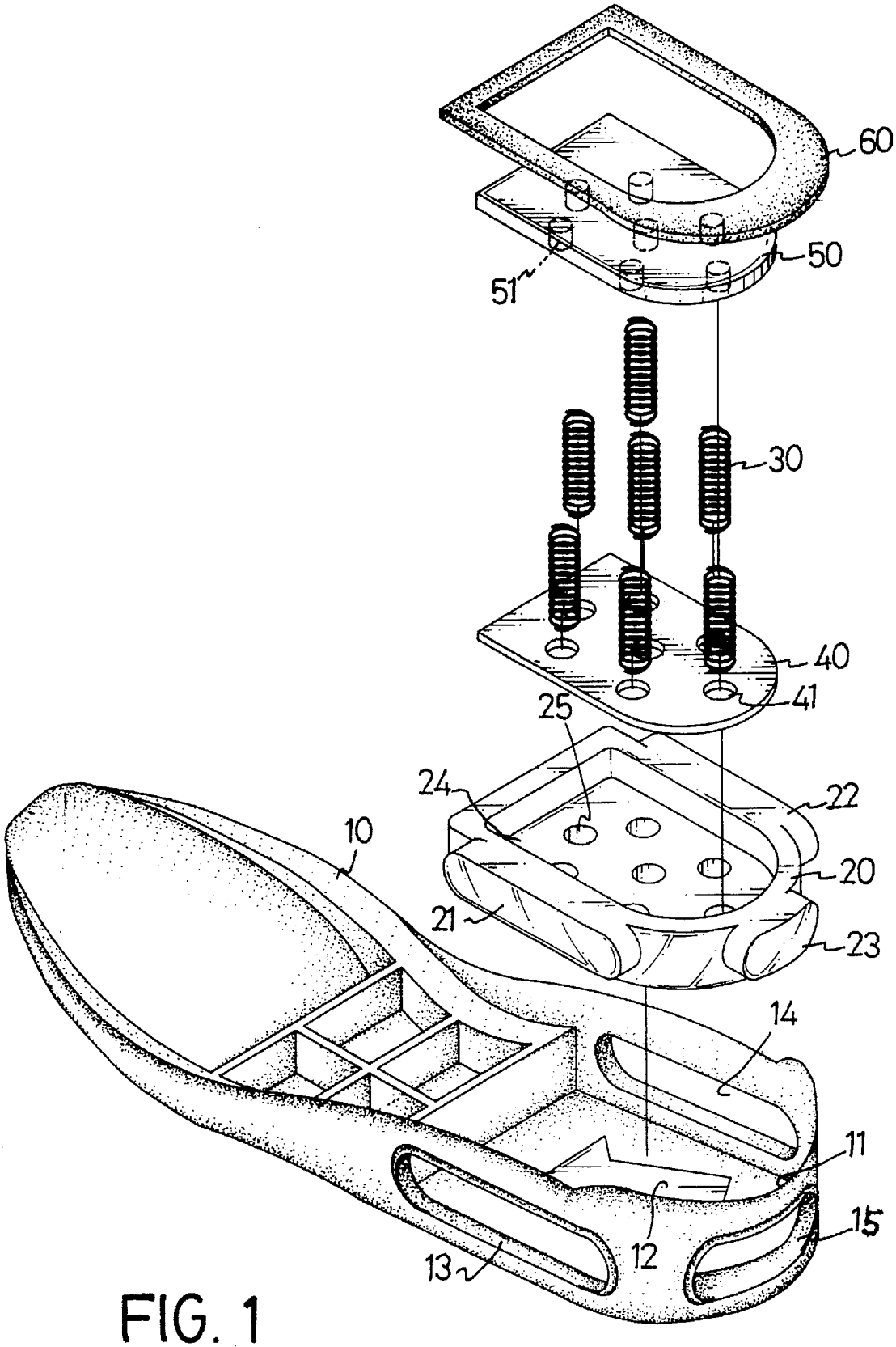
FIG. 1 is a perspective view showing a combined resilient sole of a shoe in accordance with the present invention.

Referring to the figures and initially FIG. 1, a combined resilient sole of a shoe comprises a sole body 10 defining a cavity 11 at a heel position thereof, wherein a bottom of the cavity 11 may be formed with a semitransparent sheet 12 through which a user may observe an inner part of the cavity 11. The cavity 11 of the sole body 10 further defines a first and a second through-hole 13 and 14 respectively at two sides thereof and a third through-hole 15 at a back thereof. A retaining bracket 20 has a first, a second and a third protruding block 21, 22 and 23 integrally and respectively extending from two sides thereof and a back thereof, corresponding to the first, second and third through-holes 13, 14 and 15 of the cavity 11, whereby the retaining bracket 20 may have its protruding blocks 21, 22 and 23 inserted into the respective through-holes 13, 14 and 15 and adhesively mounted within the cavity 11. The retaining bracket 20 may be formed of a hard and transparent material and further defines a recess 24 at a center thereof and a plurality of blind holes 25 in a surface defining the recess 24. A plurality of springs 30 is respectively and vertically disposed in the blind holes 25 of the recess 24. A footstock 50 with a dimension the same as that of the surface of the retaining bracket 20 is movably disposed over the retaining bracket 20. The footstock 50 has a plurality of bosses 51 extending from an undersurface thereof. The bosses 51 may be configured as cylinders to be retained within an upper end of a corresponding spring 30, whereby the springs 30 may be compressed between the retaining bracket 20 and the footstock 50. In a preferred embodiment, a setting sheet 40 with a dimension the same as that of the surface of the recess 24 is disposed between the footstock 50 and the recess 24. The setting sheet 40 may be made of a PVC material and defines a plurality of holes 41 therein aligning with the blind holes 25 in the recess 24, through which the springs 30 may extend.

To enhance the resilience of the shoe, the invention further comprises a layer of sponge 60 covered on the top periphery of the retaining bracket 20. The layer of sponge 60 is configured as a hollow frame so that the footstock 50 may freely move therethrough. On top of the footstock 50, a buffer 70 may be suitably disposed.

Figure 2:
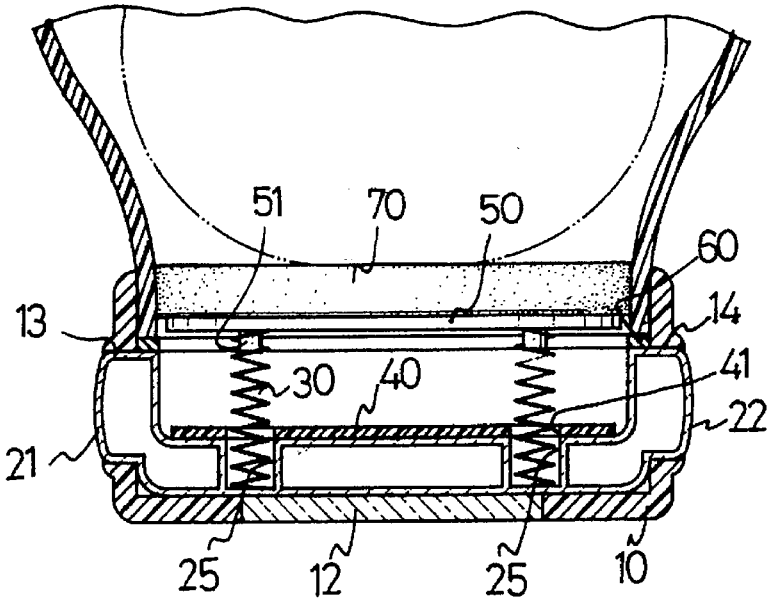
FIG. 2 is a cross-sectional view showing the combined structure of the sole in accordance with the present invention.
Figure 3:
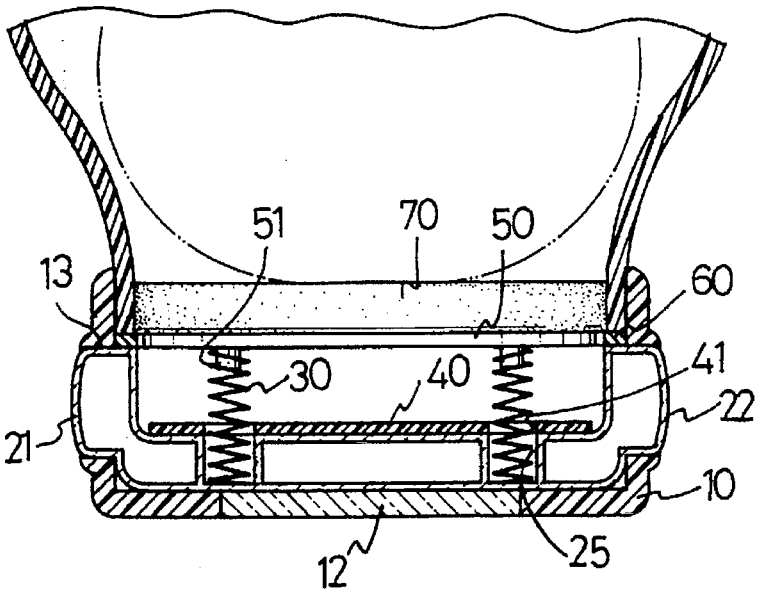
FIG. 3 is a cross-sectional view showing the combination and operation of the sole in accordance with the present invention.

In assembly and operation, referring to FIG. 2 and FIG. 3, it is to be noted that when the shoes are not in use, the springs are freely extended and a top of the footstock 50 is higher than a top of the layer of sponge 60 (as shown in FIG. 2). When a user is stepping or running, his/her heel presses the footstock 50 downwardly so that the top of the footstock 50 is lower than that of the layer of sponge 60 so that the springs 30 are compressed (as shown in FIG. 3). As the user starts to raise his foot to begin another step, the springs 30 urge the foot upwardly. Furthermore, since the layer of sponge 60 may also provide an excellent resilience, thus it is appreciated that the thicker the layer of sponge 60 is, the larger the resilience is, it is easy for the footstock 50 to return to its initial position when the user again is to raise his/her foot to step.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A combined resilient sole of a shoe comprising:

a sole body defining a cavity at a heel position thereof;

a retaining bracket mounted within the cavity, the retaining bracket defining a recess at a center thereof and a plurality of blind holes in an upper surface of the recess;

a plurality of springs respectively and vertically disposed in the blind holes; and a footstock having a dimension the same as that of the upper surface of the recess and being disposed over a setting sheet, said footstock having a plurality of bosses extending from an undersurface thereof and each boss respectively retained within an upper end of the springs, thereby compressing the springs between the retaining bracket and the footstock.

2. A combined resilient sole of a shoe as claimed in claim 1, wherein a periphery of the cavity of the sole body defines three through-holes at two sides and a back thereof, respectively, and wherein the retaining bracket has three protruding blocks integrally formed at two sides and a back thereof corresponding to the through-holes of the cavity, whereby the retaining bracket may engaged within the cavity.

3. A combined resilient sole of a shoe as claimed in claim 1, wherein a bottom defining the cavity of the sole body is formed of a semitransparent sheet.

4. A combined resilient sole of a shoe as claimed in claim 1, wherein the retaining bracket is formed of a hard and transparent material.

5. A combined resilient sole of a shoe as claimed in claim 1, further comprising a setting sheet disposed in the recess, said setting sheet having a same dimension as that of the surface defining the recess and which is made of a PVC material, said setting sheet disposed in the recess and defining a plurality of holes therein aligning with the blind holes in the surface defining the recess, through which the springs may extend.

6. A combined resilient sole of a shoe as claimed in claim 1, further comprising a layer of sponge covered on a top periphery of the retaining bracket to provide a resilient effect, the layer of sponge being configured as a frame.

7. A combined resilient sole of a shoe as claimed in claim 1, wherein the bosses of the footstock are respectively configured as cylinders.

* * * * *